United States Patent [19]

Mándoki

[11] 4,056,703

[45] Nov. 1, 1977

[54] PROCESS AND APPARATUS FOR RESISTANCE HEATING OF ELECTRICALLY CONDUCTIVE WORKPIECES

[75] Inventor: Andor Mándoki, Budapest, Hungary

[73] Assignee: "Licencia" Talalmanyokat Ertekesito Vallalat, Budapest, Hungary

[21] Appl. No.: 626,131

[22] Filed: Oct. 28, 1975

[30] Foreign Application Priority Data

Oct. 30, 1974 Hungary ..... MA 2611

[51] Int. Cl.[2] ..... H05B 3/00

[52] U.S. Cl. ..... 219/71; 148/150; 148/154; 174/9 F; 219/155; 266/104; 266/120; 339/118 R

[58] Field of Search ..... 148/150, 154, 156, 157; 174/9 F; 200/183, 185, 191, 192; 219/50, 71, 119, 162, 155; 266/104, 120; 339/118 R, 118 RY

[56] References Cited

U.S. PATENT DOCUMENTS

| | | | |
|---|---|---|---|
| 499,964 | 6/1893 | Burton et al. | 219/71 X |
| 520,360 | 5/1894 | Hunter | 219/71 X |
| 3,313,269 | 4/1967 | Hough | 219/50 X |
| 3,567,897 | 3/1971 | Inoue | 219/71 |
| 3,861,658 | 1/1975 | Prohászka et al. | 219/71 X |

*Primary Examiner*—J. V. Truhe
*Assistant Examiner*—N. D. Herkamp
*Attorney, Agent, or Firm*—Young & Thompson

[57] ABSTRACT

Elongated electrically-conductive workpieces such as bars, strips and wire, are resistance heated by passing an electric current through a length of the workpiece between a pair of spaced contacts. The contacts are electrically-conductive molten metal or molten salt, the molten material being continuously circulated to move it toward and into contact with the workpiece, so that it is not necessary to bend the workpiece to immerse it in a bath of molten material. The molten material is moved against the workpiece to form an extending portion of the molten material as a contact, by projecting it as a jet, pouring it as a stream, or causing it to flow over a subjacent supporting surface.

9 Claims, 39 Drawing Figures

PROCESS AND APPARATUS FOR RESISTANCE HEATING OF ELECTRICALLY CONDUCTIVE WORKPIECES

The present invention relates to a process and apparatus for the resistance heating of electrically conductive workpieces.

Electric current may be conducted to workpieces by means of sliding or rolling contacts. However, there is then the risk of spark formation on rough and uneven surfaces, particularly when the workpieces move at high speed, and such sparking injures the surface of the workpiece. Rolling contacts also have the disadvantage that the contacting surface can be increased only by increasing the number of rollers or cylinders; and so the force which is thus applied to the workpiece is increased.

In order to eliminate these drawbacks, molten metal baths can be used as contacts. However, the workpieces then must be bent under the surface of the bath. Only thin flexible wires or strips can pass through such a contact system. Wires or strips of greater cross section, and rolled sections, steel bars and pipes are unsuited for the use of this type of a contact.

Molten metal baths can eliminate this latter drawback, in which current supply to the workpieces continuously moving above the surface of the contact bath is effected by raising a part of the surface of the metal bath, only this raised part coming into contact with the workpiece, whereby the contact providing for the conduction of electric current is established. But with this arrangement, the maintenance of the molten metal at a constant level and the variation and the unevenness of the contact surface of the liquid may cause difficulties. Moreover, the lifted liquid surface provides a contact surface that is variable in area. Still further, the failure of the molten metal lifting means will immediately interrupt the contact. Also, it is not always possible to contact the workpiece from below.

In the prior art, the surface, size, shape, bodily orientation and speed of travel of the workpiece limited the possibilities for the use of such systems and a trouble-free power supply cannot be ensured in all cases.

The present invention has as its object the elimination of the above disadvantages and the provision of a more versatile contact system with surer power transmission. Thus, the present invention provides a molten liquid power transmission surface with which stationary or moving workpieces having quite different sizes, shapes and surfaces can all be contacted for reliable current transmission.

By the present invention, molten metals, alloys or metallic salts flow, stream or are poured, and a section of free surface of the molten material is established which is suitable for transmitting the heating current conducted into the molten material, either to stationary or to moving workpieces. The current transmission occurs in the section of free surface that results from the vertical or inclined or horizontal flow of the electrically conductive molten material. The thickness and surface area of the molten material provided in this way are uniform and any surface or edge or corner of the stationary or continuously moving workpiece can be contacted therewith in order to establish a steady contact and continuous current transmission. If this free surface is provided by an unconfined jet of molten material, then it is not necessary to support the molten material against a solid surface. In this case, the molten material is directed at and against the workpiece.

By pouring, flowing or streaming the molten material in vertical, inclined or horizontal directions, a section of molten material of controllable thickness and controllable surface can be produced according to the invention, which is well suited to the transmission of heating current through contact with the workpiece. In this way, the thickness of the molten material, the area of its free surface, and the uniformity of this free surface can be regulated, as is required for establishing contact between the workpiece and the molten material regardless of the orientation or shape or size of the workpiece to be heated.

The present invention has the advantage, as compared to solid contacts, that spark formation does not take place and the corresponding damage to the surface of the workpiece is avoided. As compared to molten material contacts known heretofore, the present invention provides for a controllable surface of molten material. Such a surface can be of any desired size. Its surface is uniform and so is highly advantageous for contact purposes.

The molten material can be kept in motion by constantly circulating the same. The circulation of the molten material can be carried out by a mechanical pump, such as a vane or gear pump or worm-gear pump; but it can also be effected by an electrodynamic or induction pump.

The contact surface according to the invention is a bath of molten material which is constantly moving, its required section of free surface being established by pouring, flowing or streaming the same.

The molten material may be molten metal or a molten salt or a molten metal alloy. Melting can be effected by any desired heating method, the most advantageous being electric-resistance heating. It may be necessary to provide cooling means to prevent overheating of the bath of molten material.

The formation of the required free surface of the molten material may be effected, according to the invention, by means of a deflecting element in a refractory-lined housing, the element having an exposed surface for guiding the layer of molten material, whereas in the side wall of the housing an access aperture to this free surface is provided. Through this aperture the workpiece can be brought into contact with the free surface for establishing contact. A reservoir receives the molten material which can be constantly circulated. The terminal for applying heating current is immersed in the molten material. The deflecting element which shapes the layer of molten material has surfaces which regulate the size and evenness of the free surface of the molten material, which can accordingly be horizontal, inclined or vertical.

Greater versatility can be achieved by applying the molten material as a free jet. The refractory housing is provided with a nozzle communicating with the reservoir for delivering the molten material and means enclosing the area of the workpiece to which the molten material is applied, thereby to return the molten material to the reservoir. The molten material can be removed from the surface of the workpiece by means of a wiper. The apparatus can be provided with heating means and with means circulating the liquid in the reservoir, as well as with electric terminals immersed in the molten material.

Several workpieces can be simultaneously handled, particularly thin wires and strips.

If oxidation occurs at the heating temperature, the workpieces can be surrounded by a protective atmosphere. Both the workpiece and the surface of the molten material can thus be protected against oxidation. In addition to its contact function, the molten material can serve to preheat, cool, harden or surface coat the workpiece.

These and other objects, features and advantages of the present invention will become apparent from a consideration of the following description, taken in connection with the accompanying drawings, in which.

Figure 1:
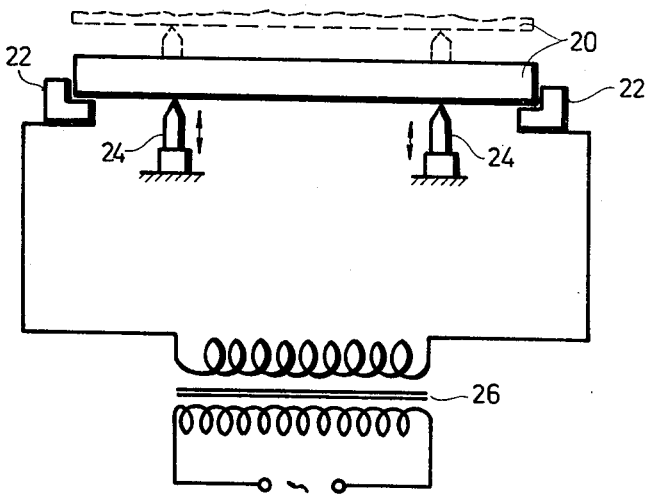
FIG. 1 is a schematic view of a first embodiment of apparatus according to the present invention, for use with stationary workpieces.
Figure 4:
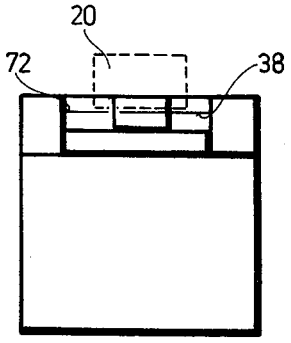
FIGS. 2, 3 and 4 are respectively side cross-sectional, top plan and end elevational views of an individual contact-forming device suitable for use in the embodiment of FIG. 1.
Figure 7:
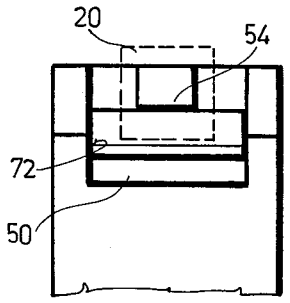
Figure 5:
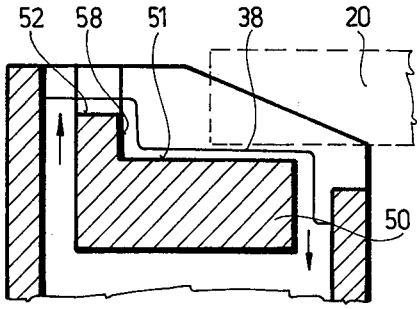
Figure 6:
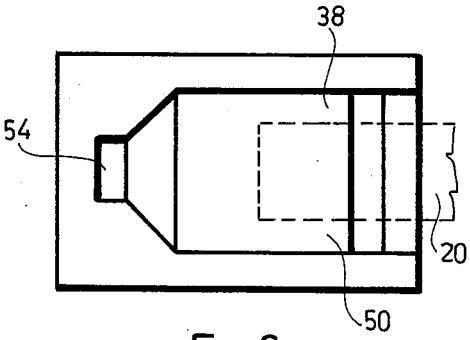
Figure 10:
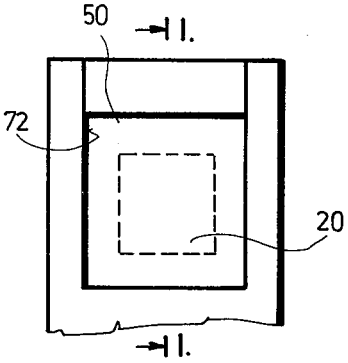
Figure 8:
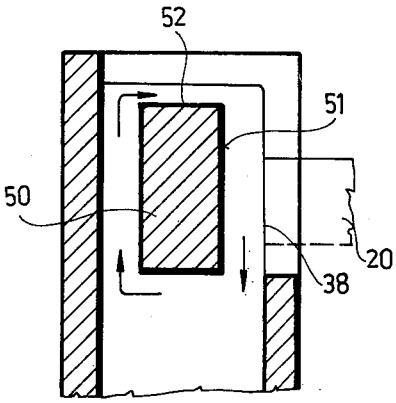
Figure 9:
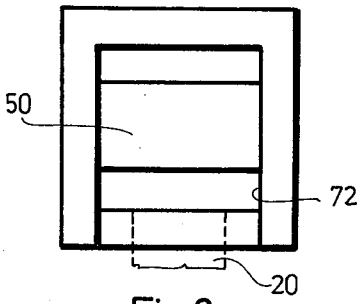
Figure 11:
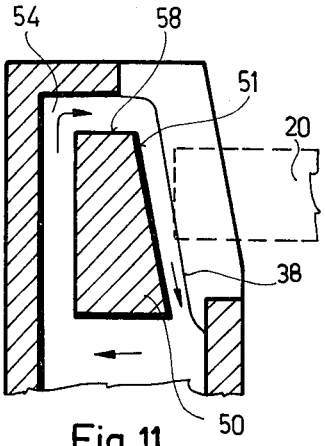
Figure 13:
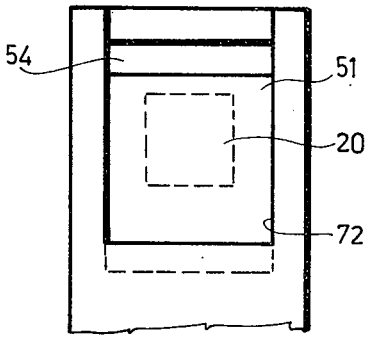
Figure 12:
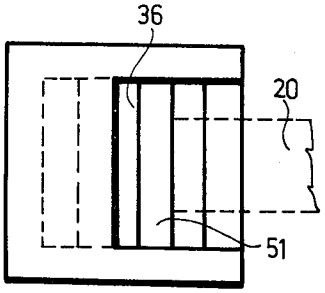
Figure 14:
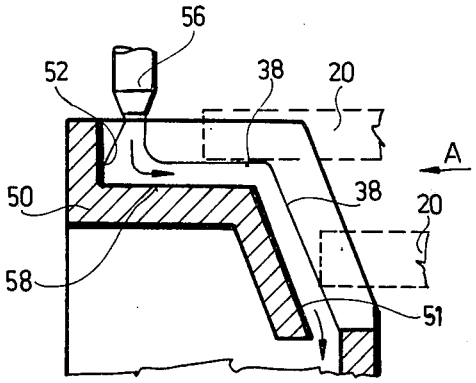
Figure 16:
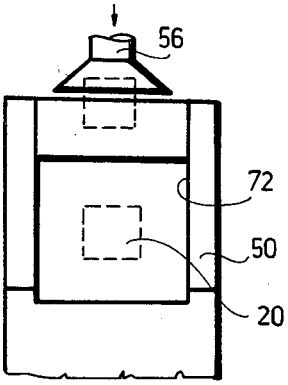
Figure 15:
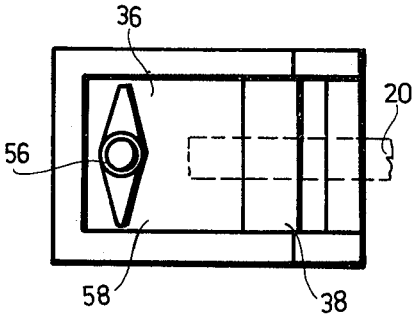
Figure 17:
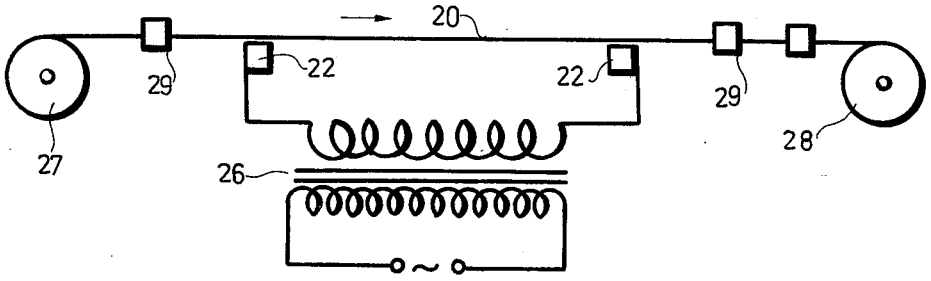
Figure 20:
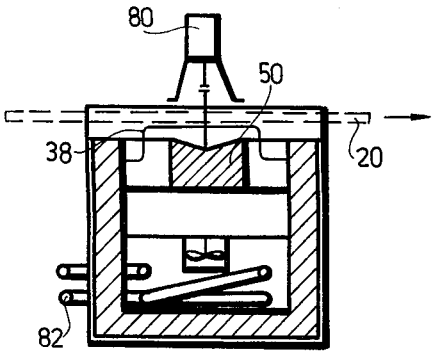
Figure 18:
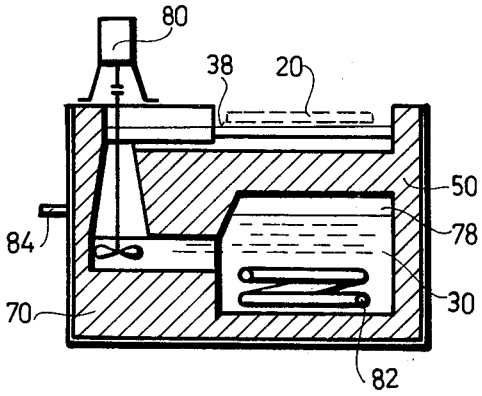
Figure 19:
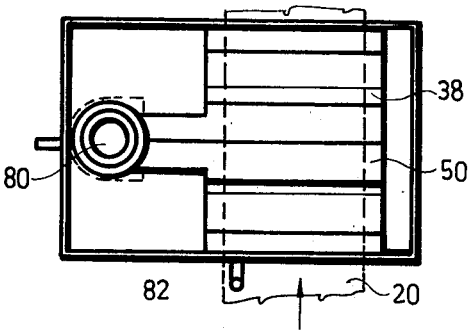
Figure 23:
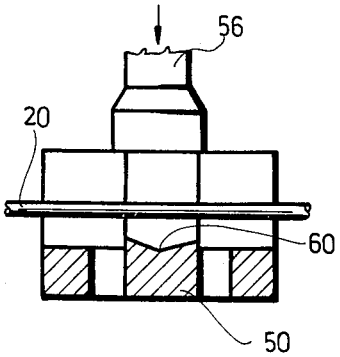
Figure 21:
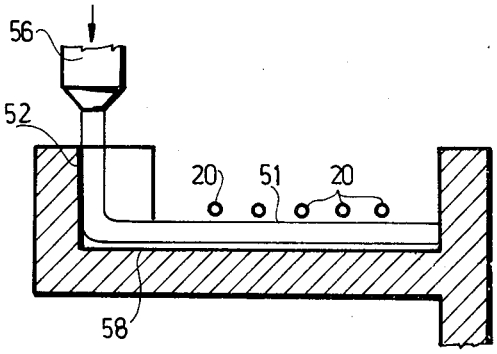
Figure 22:
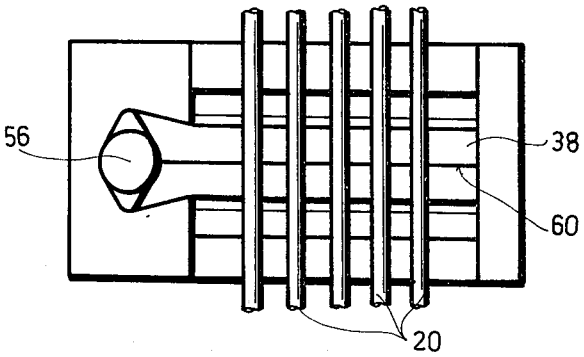
Figure 25:
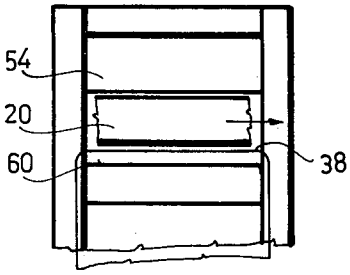
Figure 24:
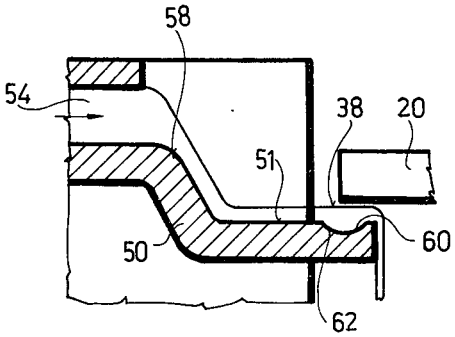
Figure 26:
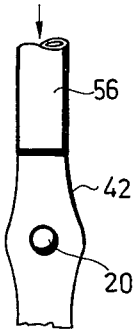
Figure 27:
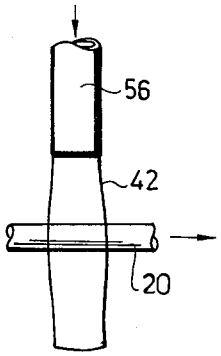
Figure 28:
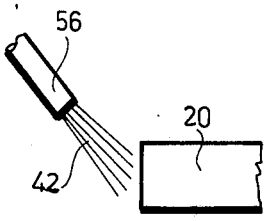
Figure 29:
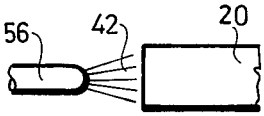
Figure 31:
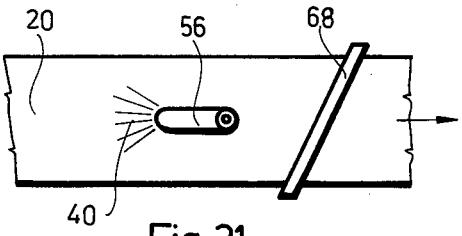
Figure 30:
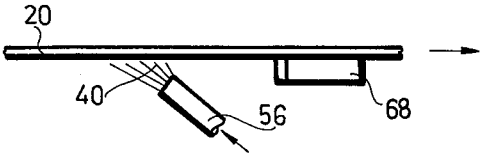
Figure 32:
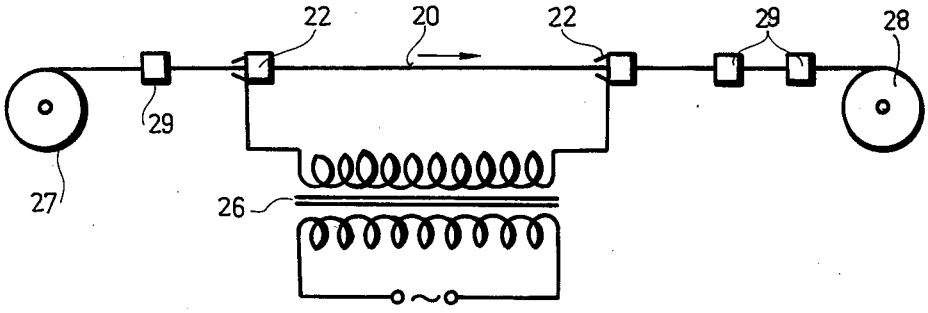
Figure 33:
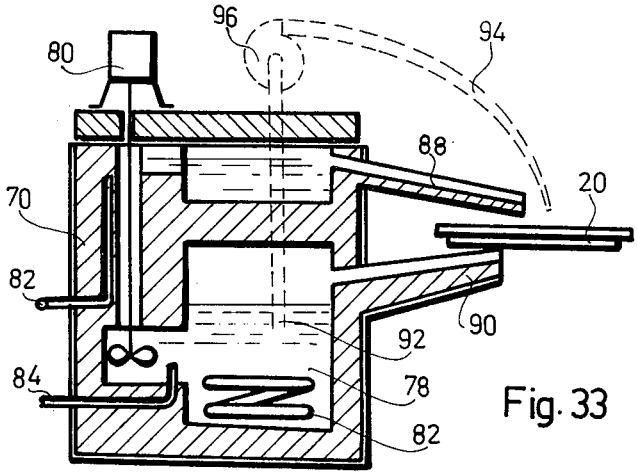
Figure 34:
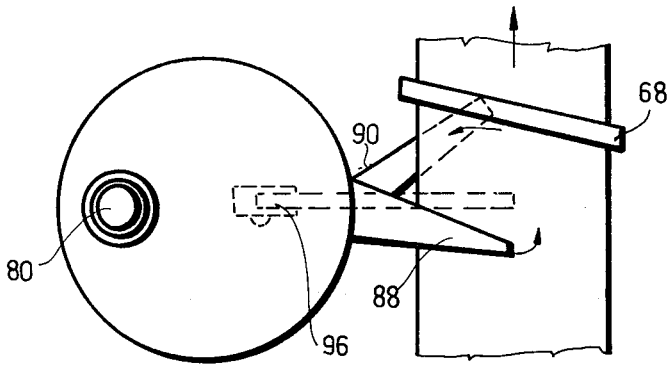
Figure 35:
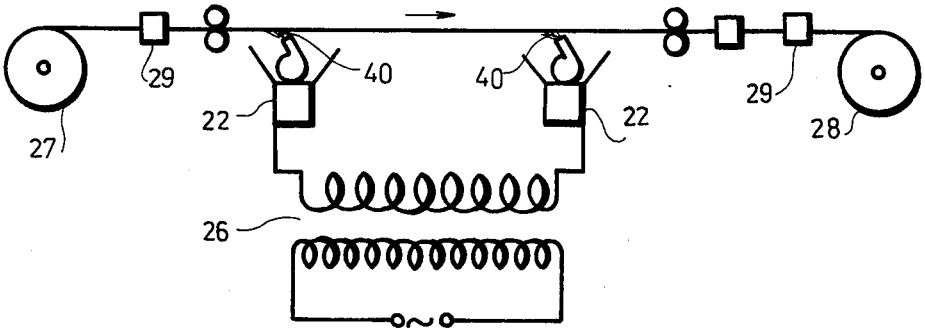
Figure 36:
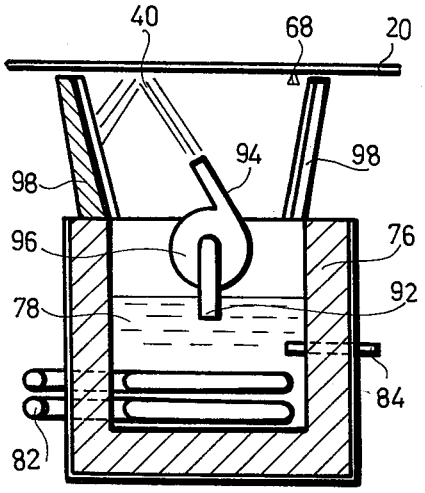
Figure 38:
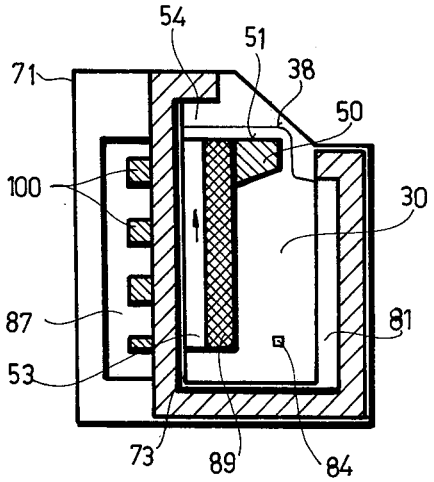
Figure 37:
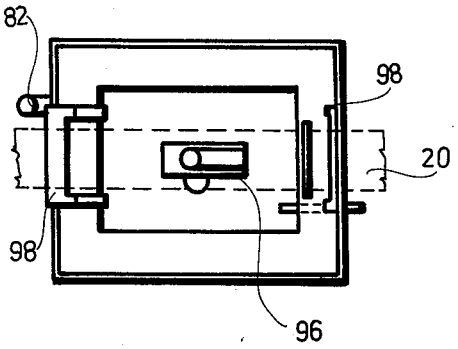
Figure 39:
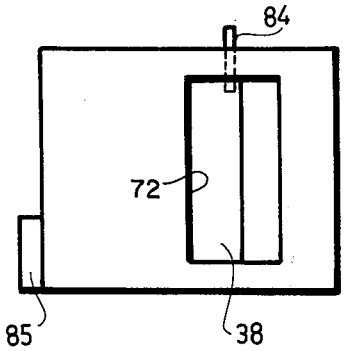

FIGS. 5, 6 and 7; FIGS. 8, 9 and 10; FIGS. 11, 12 and 13; and FIGS. 14, 15 and 16, are views similar to FIGS. 2, 3 and 4, respectively, but of further embodiments thereof;

FIG. 17 is a view similar to FIG. 1 but showing another embodiment of the overall apparatus;

FIGS. 18, 19 and 20 are respectively side cross-sectional, top plan and end cross-sectional views of one of the contact-forming devices of FIG. 17, on an enlarged scale;

FIGS. 21, 22 and 23 are views similar to FIGS. 18, 19 and 20, respectively, but showing a modified contact for use with FIG. 17;

FIGS. 24 and 25 are respectively fragmentary side cross-sectional and end elevational views of a contact suitable for use with the embodiment of FIG. 17, but on an enlarged scale;

FIGS. 26 and 27 are elevational views of a further embodiment of contact suitable for use with FIG. 17;

FIGS. 28 and 29 are respectively elevational and top plan views of a further embodiment of contact;

FIGS. 30 and 31 are respectively elevational and bottom plan views of a further embodiment of contact;

FIG. 32 is a third embodiment of overall apparatus according to the present invention;

FIGS. 33 and 34 are respectively side cross-sectional and top plan views of a contact for use in the FIG. 32 embodiment, but on an enlarged scale;

FIG. 35 is a view similar to FIGS. 1, 17 and 32, but of a fourth embodiment of overall apparatus according to the present invention;

FIGS. 36 and 37 are respectively side cross-sectional and bottom plan views of a contact suitable for use with the embodiment of FIG. 32 but on an enlarged scale; and FIGS. 38 and 39 are respectively side cross-sectional and top plan views of still another embodiment of contact suitable for use with the FIG. 1 embodiment.

In the drawings, the same reference numerals indicate similar parts.

Referring now to the drawings in greater detail, and first to FIG. 1, there is shown the electric-resistance heating of a stationary workpiece 20 by means of contacts 22. Workpiece 20 can be raised and lowered relative to contacts 22 by lifting mechanisms 24. The heating current flows through transformer 26 and between contacts 22 through workpiece 20.

Figure 2:
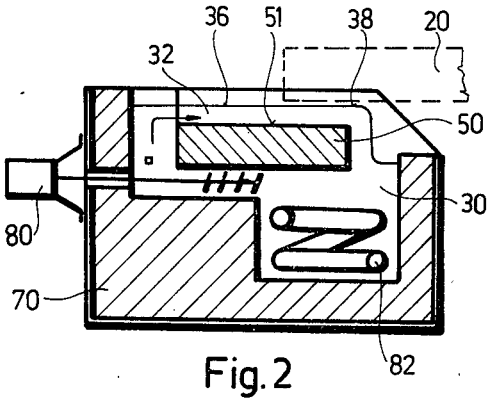

FIG. 2 shows a first embodiment of contact 22 suitable for the provision of a free molten material contact surface, for heating the stationary workpieces 20. The heating filament 82 melts the metal or molten salt and is arranged in a refractory housing 70. The circulation of the bath 30 of molten material is insured by pump 80. The circulating molten material has a portion 32 that flows over horizontal surface 51 of the deflector 50. Free surface 38 of portion 32 contacts workpiece 20.

Figure 3:
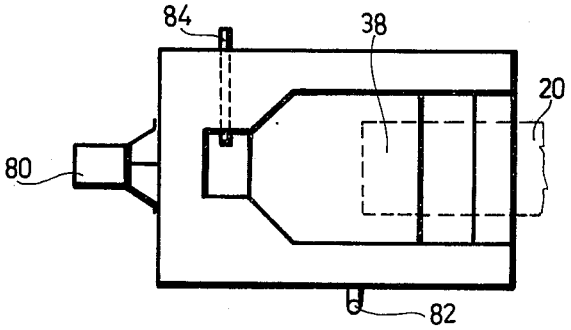

FIG. 3 shows in plan view the free surface 38, the connection 84 for the introduction of heating current, and heating element 82.

FIG. 4 shows a free aperture 72 through which the workpiece 20 is brought into contact with free surface 38.

The use of apparatus providing a free surface on at least one side of the molten material has the advantage, mentioned above, compared to solid contacts, that no spark formation occurs and the accompanying surface damage of the workpiece is avoided. In comparison with melt contacts used hitherto, the present invention makes possible the regulation of the surface of the molten material. A current-transmitting surface of optional size and shape can be established. The free surface is suitable for contacting both stationary and moving workpieces. The heating unit for melting the material can be arranged in a reservoir and is in fixedly secured relationship with the pump and so the construction of the apparatus is simplified, its manufacture is less expensive, and its operation is easier.

FIG. 5 shows another embodiment of contact having a deflecting element 50 having a support surface 51. The inlet surface 52 and the surface 58 serve to direct the molten material. In the top plan view of FIG. 6, the inlet opening 54, the deflecting element 50 and the free or contact surface 38 are shown. FIG. 7 shows the free aperture 72 for admitting the workpiece 20.

FIG. 8 shows still another embodiment of contact in which the deflector 50 has inlet surface 52 and supporting surface 51 which in this embodiment is vertical, so that the free surface 38 is vertical. In FIGS. 9 and 10 the free aperture 72 is shown for admitting the workpiece.

FIG. 11 shows still another embodiment of contact, in which the deflecting element 50 has an inclined supporting surface 51. The inlet opening 54 and the adjacent surface 58 help to form the free surface 38 which is also shown in FIG. 12. FIG. 13 shows the free aperture 72 for admitting the workpiece 20.

FIG. 14 shows yet another embodiment of contact, in which the deflector 50 establishes a horizontal support surface 58 and an inclined support surface 51. Molten material streams from a supply conduit 56 past the surfaces 52 and 58, the workpiece gaining entry through the aperture 72 which is best seen in FIG. 16.

As indicated above, the support surfaces 51 help determine the size and shape and position of the free surface of the molten material. In this way, the free surface can be horizontal, inclined or vertical and can be formed by flowing, pouring or streaming. The aperture that exposes the free surface makes it possible for the workpiece to contact that free surface.

The surface upstream of the support surface serves to spread out the inflowing molten material and helps achieve a layer of uniform thickness. This surface can be at a predetermined angle to the support surface so as to provide any desired change in the inclination of the free surface of the molten material.

FIG. 17 shows another embodiment of the overall equipment for a continuously moving workpiece 20 in the form of a strip or wire running between an unwinding mechanism 27 and a rewinding mechanism 28 and passing through appropriate machine tools 29 arranged upstream and downstream of the contacts 22. Heating of the material between the contacts 22 is effected by heating current supplied by transformer 26.

FIG. 18 shows a contact 22 suitable for use in the embodiment of FIG. 17, providing a free surface 38 adapted to contact the moving workpiece 20. A melting space or reservoir 78 in a refractory housing 70 contains a heating coil 82 that melts the metal or salt. Rotary pump 80 circulates the molten material 30. The circulated molten material 30 is shaped to form the free surface 38 by means of the deflector 50. Terminal 84 supplies current through the molten material. In FIG. 19, free surface 38 is again seen; while in FIG. 20 the cross-sectional configuration of the deflector 50 is seen.

FIG. 21 shows a contact for the simultaneous heating of several workpieces 20 moving in parallelism to each other, comprising a deflector 50 fed by an inlet conduit 56, the molten material passing the vertical inlet surface 52 and a further inlet surface 58. The free surface 38 shown in FIG. 22 is developed on the support surface 51. FIG. 23 shows the trough 60 of the deflector 50.

Another embodiment of contact is shown in FIG. 24, in which the deflector 50 forms a layer of molten metal that contacts one edge of a continuously advancing workpiece 20. Inlet opening 54 and surface 58 cooperate to form the free surface 38 on support surface 51 that in turn contacts the workpiece 20. Trough 60 also helps develop the free surface 38 as seen in FIG. 25.

Trough 60 in the supporting surface promotes the uniformity of the free surface of the molten material and insures that the molten material spreads out on the support surface in the direction of movement of the workpiece and runs off the ends of the support surface, thereby promoting contact between the workpiece and the free surface of the molten material. In FIGS. 21–23, trough 60 is V-shaped in cross section; but in FIGS. 24 and 25, the bottom of trough 60 is curved as shown at 62.

FIGS. 26 and 27 show a stream 42 of molten material pouring from a conduit 56 and flowing around the workpiece 20 which is guided therethrough. FIGS. 28 and 29 show a stream or jet 42 of molten material directed diagonally downward from conduit 56, for contacting a stationary workpiece 20. FIGS. 30 and 31 show a stream or jet 40 directed upwardly from below against a continuously moving workpiece 20 in the form of a strip, a wiper 68 removing excess molten material from the underside of the strip.

When the molten material is in the form of a free jet, it is suitable for more versatile usage. It can contact the workpiece in every possible position of the workpiece. The workpiece does not have to be brought into contact with the molten material, but rather the molten material is brought to the workpiece and hence surrounds the same. Thus the construction of the device is simplified and the guidance of the workpiece is made easier. The advantage of a downwardly directed free jet is that workpieces of small cross section can be continuously guided through the molten material. In the case of stationary workpieces, it is highly advantageous to ensure a more intensive contacting by means of a downwardly directed free jet, since the molten material is impelled against the workpiece with force. On the other hand, a stream that falls only by gravity has the advantage that no separate power is required for impelling it.

FIG. 32 shows another embodiment of overall apparatus according to the present invention, for treating continuously moving workpieces 20, the apparatus enclosing the workpiece.

FIG. 33 shows in enlarged cross section the contact 22 comprising a refractory housing containing a heating coil for melting the metal or salt. Circulation of the molten material is effected by a rotary pump, the molten metal 30 rising and then overflowing onto the upper trough 88 whence it flows onto the upper surface of the workpiece 20. The molten material is then returned to reservoir 28 by means of wiper 68 that contacts the upper surface of workpiece 20, so that the molten material returns by way of trough 90 that inclines downwardly toward reservoir 78. Instead of the rotary pump and the upper trough 88, a bolt pump 96 shown in phantom line in FIG. 33 can also be used. The suction duct 92 of pump 96 is immersed in reservoir 78; and the discharge duct 94 of pump 96 delivers molten material to the upper side of workpiece 20.

Such a device thus delivers the contact molten material in the form of a free stream to the continuously advancing band or wire. Also, return flow to the reservoir is ensured. Thus, even workpieces travelling at high speed can be reliably contacted. The workpiece is not connected to the contact, but rather the conductive molten material is directed to the workpiece, thereby simplifying the apparatus. No support surface and deflecting element is required. The free stream conducting the heating current can be directed onto strips as well.

In FIG. 35 is shown an arrangement for the resistance heating of continuous workpieces 20, utilizing a device that directs a jet 40 of molten material upwardly from below. FIGS. 36 and 37 show that molten material 30 flows through suction duct 92 and delivery duct 94 or pump 96 onto the undersurface of workpiece 20. The two troughs 98 upstream and downstream of the delivery duct 94 ensure the return flow of the molten material into the reservoir 78. Wiper 68, disposed below the workpiece 20, removes molten material adhering to the undersurface of the workpiece 20.

This arrangement has the advantage that a simple reservoir 78 suffices. The guidance of the molten material to the workpiece is thus simplified, and the need for passages to conduct the molten material is avoided.

FIGS. 38 and 39 show another embodiment of contact suitable for use with stationary workpieces and having an induction pump. The reservoir or melting chamber 73 is enclosed with sheet casing 71 and refractory material. Electric induction coils 87 and a ferromagnetic solid cover plate of the induction pump 100 are provided; and between these is disposed the conducting channel 53 for the molten material. The melting of the material 30 is effected by an electrical heater 81. Temperature and circulation of the molten material are regulated by means of control means comprising a thermometer 85. Built-in deflector 50 forms in the previously described manner a layer of molten material having a free surface 38 on its support surface 51. The workpiece can be introduced through the free aperture 72.

The advantage of the above induction pump, as compared to mechanical pumps, is that no driving motor, transmission and mechanical moving parts are required, and so the device is less apt to fail.

From a consideration of the foregoing disclosure, therefore, it will be seen that the initially recited objects of the present invention have been achieved.

Although the present invention has been described and illustrated in connection with preferred embodiments, it is to be understood that modifications and variations may be resorted to without departing from the spirit of the invention, as those skilled in this art will readilly understand. Such modifications and variations are considered to be within the purview and scope of the present invention as defined by the appended claims.

What is claimed is:

1. A process for the resistance heating of electrically conductive workpieces, comprising establishing a solid support surface for a liquid, flowing a molten electrically-conductive material over said support surface with linear flow, maintaining a said workpiece in an undeformed condition in contact with said molten material flowing over said support surface with linear flow, and passing an electric current through said workpiece between said molten material and another electrical contact.

2. A process as claimed in claim 1, in which said another contact is also a molten electrically-conductive material flowing with linear flow over a solid support surface.

3. A process as claimed in claim 1, in which said support surface is spaced below said workpiece.

4. A process as claimed in claim 3, in which said support surface is substantially horizontal.

5. A process as claimed in claim 1, in which said workpiece is straight and stationary and said molten electrically-conductive material is applied to one end of said workpiece.

6. A process as claimed in claim 1, in which said workpiece is continuous and flexible and is straight between said contacts and to a substantial distance on each side of said contacts.

7. Apparatus for the resistance heating of electrically conductive workpieces, comprising a pair of contacts at least one of which is comprised by a molten electrically-conductive material, a solid support surface, means for continuously circulating said molten material with linear flow over said solid support surface, means for maintaining a said workpiece in an undeformed condition in contact with said molten material passing over said solid support surface with linear flow, and means for passing an electric current from one contact to the other through said workpiece.

8. Apparatus as claimed in claim 7, in which said solid support surface is substantially horizontal and said workpiece is positioned above said solid support surface.

9. Apparatus as claimed in claim 7, in which both said contacts are comprised by molten electrically-conductive material flowing with linear flow over a solid support surface.

* * * * *